US005481851A

United States Patent [19]

Koenig

[11] Patent Number: 5,481,851

[45] Date of Patent: Jan. 9, 1996

[54] MEHTOD AND APPARATUS FOR CHARGING CONTAINERS WITH HAZARDOUS MATERIALS

[76] Inventor: Larry E. Koenig, c/o Komar Industries, Inc., 4425 Marketing Pl., Groveport, Ohio 43125

[21] Appl. No.: 58,004

[22] Filed: May 3, 1993

[51] Int. Cl.[6] ..... B65B 31/02

[52] U.S. Cl. ..... 53/432; 53/510; 53/513; 53/282; 141/103; 141/144; 241/DIG. 14

[58] Field of Search ..... 53/432, 471, 510, 53/513, 281, 282; 141/97, 103, 144; 241/DIG. 14

[56] References Cited

U.S. PATENT DOCUMENTS

| | | | |
|---|---|---|---|
| Re. 15,172 | 8/1921 | Taylor | 141/103 |
| 2,426,555 | 8/1947 | Jacobs | 53/432 |
| 3,251,511 | 5/1966 | Lloyd | 222/370 |
| 3,269,612 | 8/1966 | Bode . | |
| 3,311,140 | 3/1967 | Hughes | 222/370 |
| 3,552,454 | 1/1971 | Denning, Sr. | 222/370 |
| 4,092,046 | 5/1978 | Bombelli et al. | 222/370 |
| 4,094,121 | 6/1978 | Ganholt | 53/432 |
| 4,169,419 | 10/1979 | Burgess | 111/2 |
| 4,253,615 | 3/1981 | Koenig | 241/36 |
| 4,297,827 | 11/1981 | Allison | 53/281 |
| 4,528,848 | 7/1985 | Hafner | 222/370 |
| 4,674,660 | 6/1987 | Botto | 222/181 |
| 4,893,660 | 1/1990 | Berg et al. | 141/144 |
| 4,905,454 | 3/1990 | Sanfilippo | 53/432 |
| 4,915,308 | 4/1990 | Koenig . | |
| 4,938,426 | 7/1990 | Koenig | 241/222 |
| 4,951,884 | 8/1990 | Koenig | 241/101.2 |
| 4,993,649 | 2/1991 | Koenig | 241/224 |
| 5,082,032 | 1/1992 | Crocker | 141/114 |
| 5,088,422 | 2/1992 | Koenig . | |
| 5,205,495 | 4/1993 | Garnier | 53/121 |
| 5,233,932 | 8/1993 | Robertson | 241/DIG. 14 |

*Primary Examiner*—Daniel C. Crane
*Attorney, Agent, or Firm*—Thompson Hine & Flory

[57] ABSTRACT

A rotary cartridge filler for the containerization of hazardous waste in a controlled environment, comprising an upper die module for receiving volumes of shredded waste and a lower canister module for receiving empty containers to be charged with waste from the upper module. The upper and lower modules are axially aligned and separated by a wall containing an opening for the transfer of waste from the upper module to the lower module. Both modules are mounted on a turret which rotates the modules about their axes. The upper and lower modules each contain six chambers uniformly spaced around the outer perimeter of the module and vertically aligned. In a first station, a canister enters a chamber in the lower module, and the modules are then rotated to a second station where both the upper and lower modules are purged with nitrogen. The modules are then rotated to a third station where the upper module is filled with a volume of shredded material before being rotated to a fourth station where the material is discharged to the canister in the lower module by a discharge cylinder located above the upper module. The modules are then rotated to a fifth station where the air in both modules is evacuated before being rotated to a sixth station where the filled canister is removed from the lower module.

27 Claims, 6 Drawing Sheets

MEHTOD AND APPARATUS FOR CHARGING CONTAINERS WITH HAZARDOUS MATERIALS

BACKGROUND OF THE INVENTION

This invention generally relates to waste processing systems and, more particularly, to waste processing systems which containerize shredded hazardous material in a controlled environment.

Environmental concerns and government regulation make the disposal of hazardous materials a complex task. With the amount of available landfill space rapidly decreasing, it is necessary to maximize the amount of material stored per unit volume in a landfill. In addition, such space limitations have made burning of toxic or hazardous material in incinerators, client kilns or rotary reactors an acceptable alternative. Burning of hazardous materials in a controlled, high temperature environment appears to be a relatively safe method of disposing of such material, since the complex molecules of the hazardous material are broken down into less harmful constituents.

Since such landfills and incinerator facilities typically are remote from the source of toxic or hazardous material, it is necessary to load such material in containers, such as drums, in a manner which minimizes leakage of material to the ambient and transport the drums to such landfills or incinerators.

There exist systems which reduce the size of hazardous material prior to burning in an atmosphere which is controlled to prevent leakage to the atmosphere and unintended combustion of the material handled. Such systems are connected to feed incinerators, such as rotary reactors, or the shredded material can be fed into containers for further disposal. However, these systems lack an efficient mechanized system in which the shredded material can be placed into containers in a controlled atmosphere.

Accordingly, a need exists for a container feed system in which shredded hazardous material is containerized in a controlled atmosphere which minimizes leakage to the ambient and the likelihood of unintentional combustion, and which is automated to eliminate human handling and exposure to the contents of the waste material containers.

SUMMARY OF THE INVENTION

The present invention is a rotary cartridge filler adapted to be attached to an auger shredder system for the processing and disposal of hazardous materials. The cartridge filler comprises an upper, compartmented die module for receiving discrete volumes of waste, and a lower, compartmented canister module for receiving empty canisters which are to be charged with waste. The upper and lower modules are axially aligned and are separated by a wall. Both modules are mounted on a turret which rotates the modules independently or simultaneously about a common axis their axes. The upper and lower modules each preferably contain six discrete chambers uniformly spaced about the rotational axis of the module, and the upper and lower chambers are vertically aligned.

In operation, waste is shredded and homogenized before being fed to the cartridge filler. A plastic or fiber drum enters a chamber in the lower module by an infeed conveyor at a first station. The drum and the chamber are rotated to a second station where they are purged with nitrogen. The drum and chamber are then rotated to a third station where no activity occurs in the lower module, but in the upper module the corresponding chamber is filled with a discrete volume of shredded material by a screw feeder. The modules are then rotated to place the chambers containing the canister and waste at a fourth station where a discharge cylinder, located above the die module, pushes the waste material from the upper die module, through an opening in the wall separating the upper and lower modules, and into the container in the lower module.

The modules then are rotated to place the chamber housing in the canister and upper module chamber -now empty- at a fifth station where the air remaining in both the upper and lower chambers is evacuated to a charcoal canister, or other emission treatment revise. Finally, the modules are rotated to place the filled canister at a sixth station where the canister is removed from the module by a discharge conveyor. Of course, while the lower module chamber is rotated from the second through the sixth stations, the other five chambers each pass through the stations, and are sequentially loaded with a drum, purged, charged with waste evacuated, and the charged drum is discharged. Similarly, the chambers of the upper module are sequentially charged with material, the material is transferred to the canister in the lower module, and the chambers are evacuated.

Accordingly, it is an object of the present invention to provide a waste containerization system which is used in conjunction with an auger shredder system; a waste containerization system in which hazardous or toxic waste is containerized to minimize the possibility of leakage to the ambient; a waste containerization system which is fully mechanized; a waste containerization system in which the hazardous waste is containerized in an environment which minimizes the likelihood of explosions and fires; and a waste containerization system where during container loading a plurality of containers are filled sequentially in a controlled environment.

Other objects and advantages of the present invention will be apparent from the following description, the accompanying drawings, and the appended claims.

DETAILED DESCRIPTION

Figure 1:
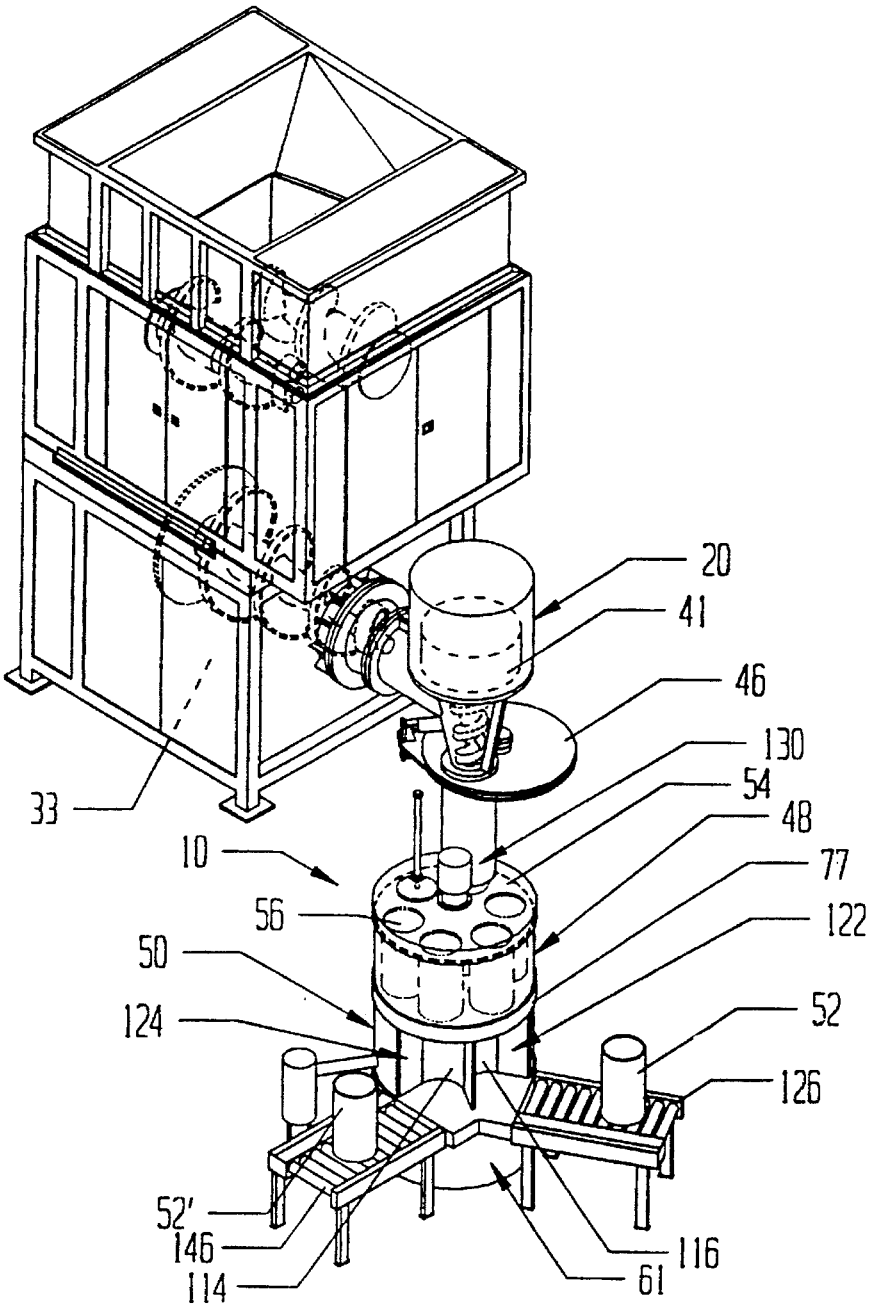
FIG. 1 is a perspective view of a waste containerization system embodying the present invention.
Figure 2:
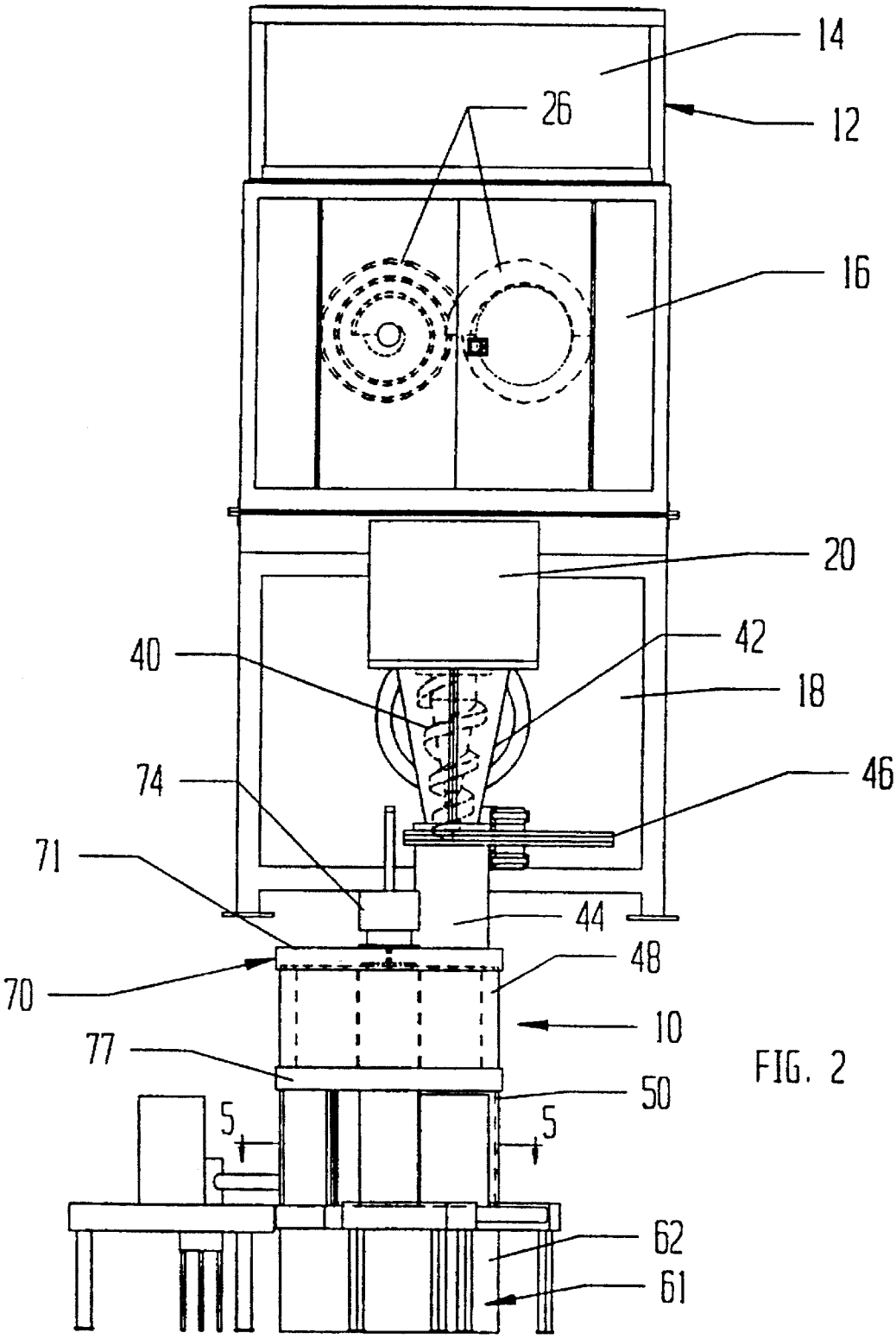
FIG. 2 is a front elevational view of the waste containerization system of FIG. 1.
Figure 3:
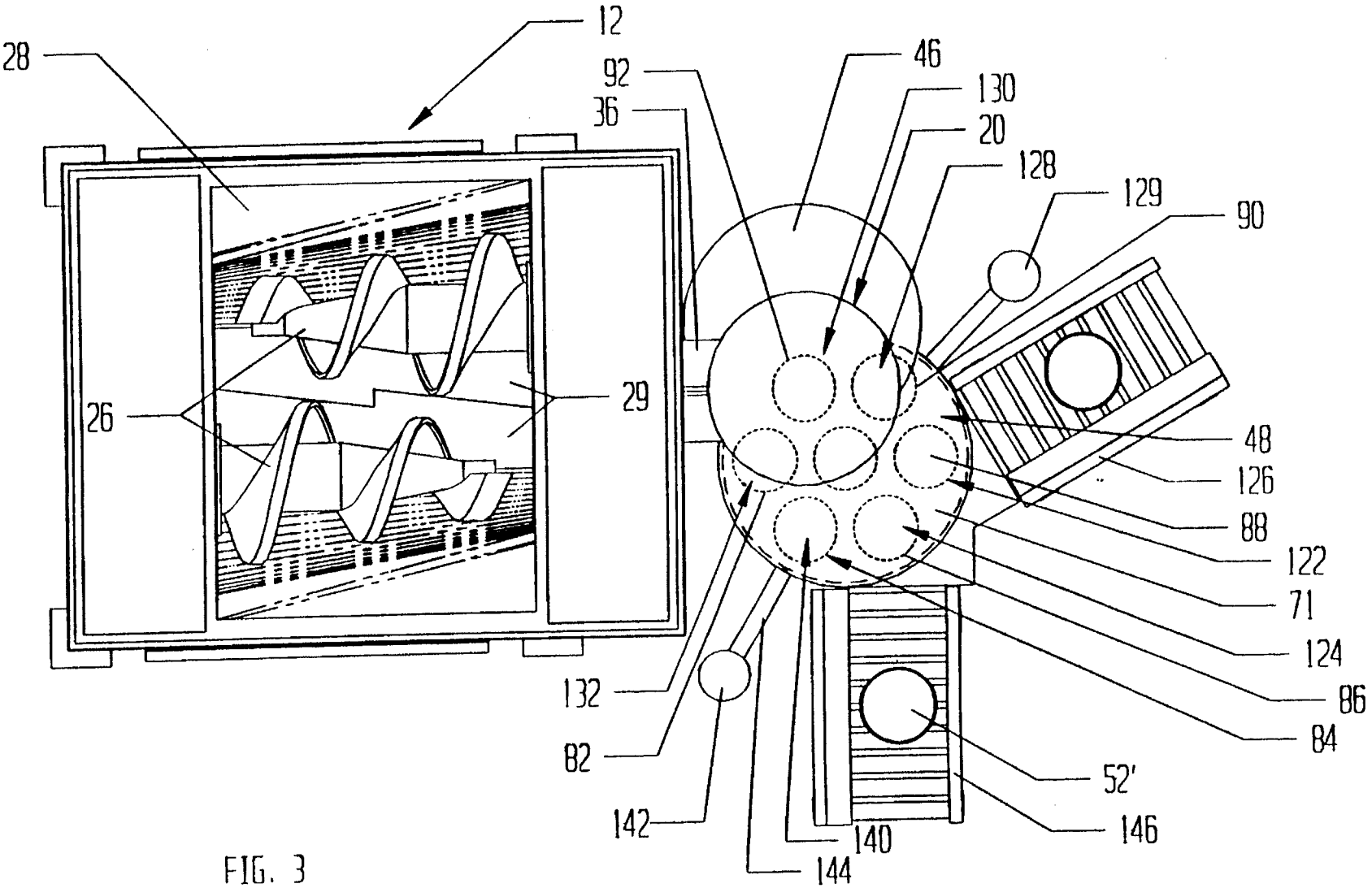
FIG. 3 is a top plan view of the waste containerization system of FIG. 1.

As shown in FIGS. 1–3, the cartridge filler of the present invention, generally designated 10, is used for the containerization of processed hazardous or toxic materials. The cartridge filler 10 is attached to and receives waste material from a sealed auger shredder system 12. The auger shredder system 12 includes a drop chamber 14, a primary grinding component 16 positioned below the drop chamber, a secondary or base grinding component 18 positioned below the primary grinding component, and a feeding or injector component 20 which interconnects the system 12 with the cartridge filler 10.

The drop chamber 14 includes a rectangular housing 22, which may include explosion doors and an air lock (not shown) covering the upper opening. The primary component 16 includes a dual auger shredder having a pair of reverse-oriented, tapered augers 26 positioned within a grinding chamber 28 contoured to the shape of the augers. The bottom of the grinding chamber 28 includes a pair of adjustable discharge doors 29 (see FIG. 3). This apparatus is disclosed in greater detail in U.S. Pat. Nos. 4,938,426 and 4,993,649, the disclosures of which are incorporated herein by reference. The primary component 16 includes an open top which communicates directly with the drop chamber 14.

As shown in FIGS. 2 and 3, the secondary component 18 is positioned directly beneath the primary component 16 and includes a single tapered auger 32 mounted within a grinding chamber 33 shaped to the contour of the auger. The design details of the single auger 32 and grinding chamber are disclosed in greater detail in U.S. Pat. Nos. 4,253,615 and 4,951,884, the disclosures of which are incorporated herein by reference.

The auger 32 of the secondary component 18 projects into an extrusion tube 36 which extends from the grinding chamber of base component 18 generally horizontally. The extrusion tube 36 is connected to the housing 38 of the feeding component 20 and provides a side discharge for secondary component 18. The feeding component 20 includes a single tapered screw 40 powered by a hydraulic motor 41 and extends substantially vertically. The screw 40 is rotatable mounted within a tapered injector tube 42 which forms a part of housing 38. The injector tube 42 includes a non-tapered section 44 having a rotary gate 46, which can be actuated to open and close section 44 between the cartridge filler 10 and the screw 40. The details of the design of the rotary gate 46 are disclosed in U.S. Pat. No. 5,088,422 and of the feeding component 20 in U.S. Pat. No. 4,915,308, the disclosures of which are incorporated herein by reference.

The auger shredder system 12 can receive hazardous or toxic material in either bulk or containerized form and reduces such material to a homogenous consistency of predetermined particle size. The hazardous or toxic material is received in the drop chamber 14 and falls downwardly into the primary grinding component 16, which initially shreds the waste material. The doors 29 located in grinding chamber 28 are adjustable to allow the residence time of the material in the chamber to be selectively varied, thereby controlling the ultimate size of the material leaving the chamber. After being initially shredded, the material enters the chamber 33 of the secondary grinding component 18 where the material is further reduced in size before being discharged into the feeding component 20.

Figure 4:
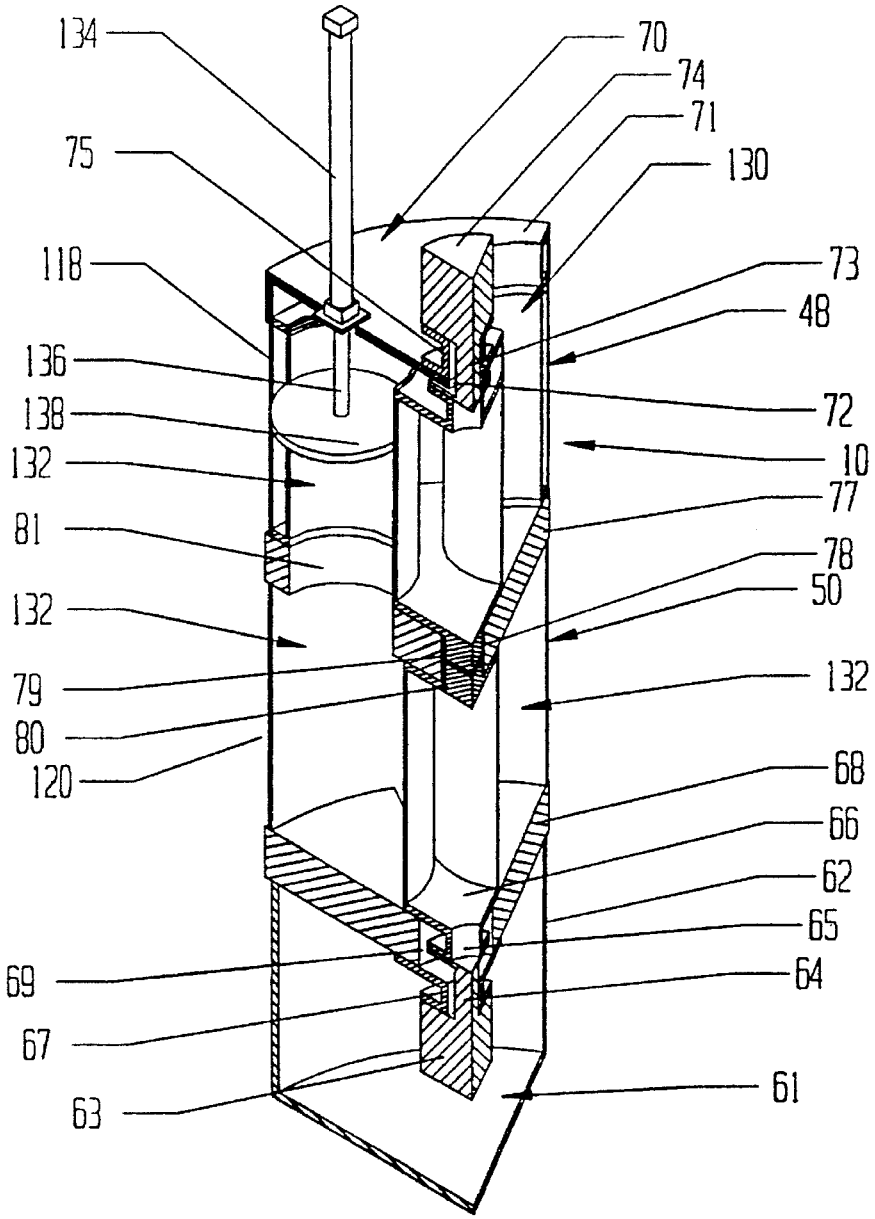
FIG. 4 is a detail in the section of the system taken along line 4—4 of FIG. 1.
Figure 5:
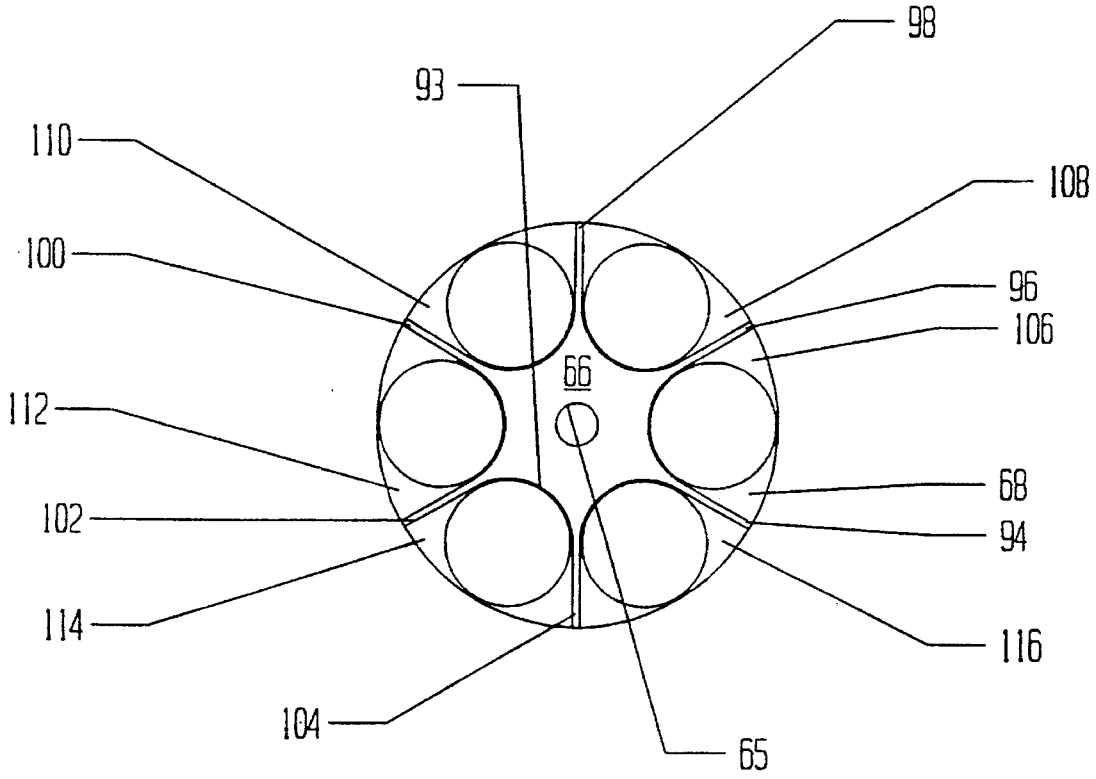
FIG. 5 is a section taken at line 5—5 of FIG. 1.
Figure 6:
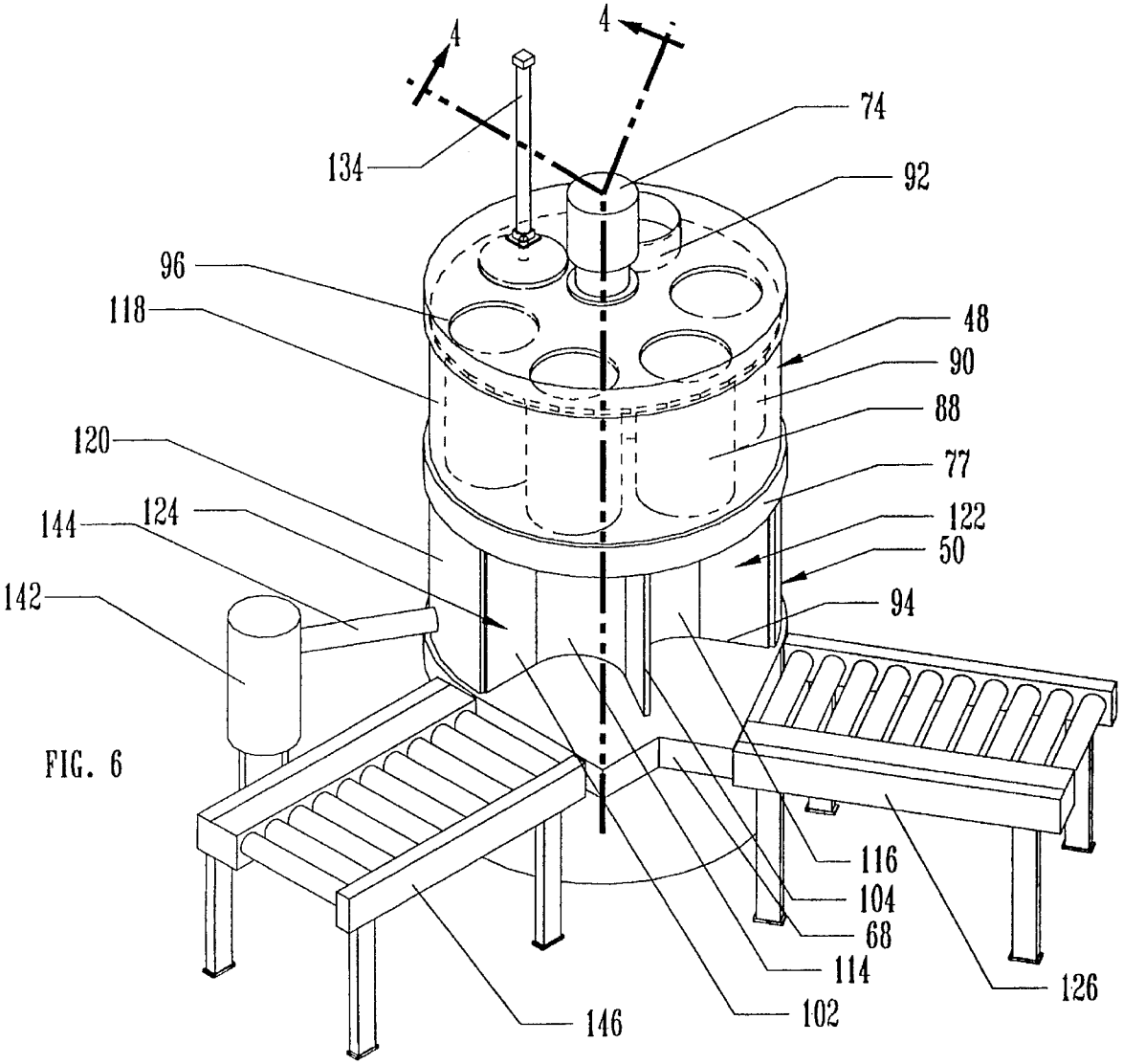
FIG. 6 is a perspective view of the cartridge filler of the present invention.

Once the hazardous material has been reduced and moved into the feeding component 20, it is ready to be containerized in a controlled environment. As also shown in FIG. 4, the cartridge filler 10 comprises an upper or die module 48 for receiving discrete volumes of waste, and a lower or canister module 50 for receiving empty canisters 52 to be ultimately charged with waste. The upper module 48 includes a lid 54 which is attached to the non-tapered section 44 of the injector tube 42.(see FIGS. 1 and 2) Lid 54 includes an opening 56 which communicates with section 44, through which the shredded material may pass from tube 42 into the upper die module 48.

The upper and lower modules 48, 50 are axially aligned. Both the upper and lower modules are mounted on a turret 61 which rotates the modules about a common vertical axis.

The turret 61 includes a housing 62 which encloses a hydraulic drive motor 63 having an output shaft 64 connected to a central hub 65 of the lower module 50. The hub 65 is integral with the floor 66 of the lower module 50. The drive motor 63 is mounted on a bracket 67 which is attached to the underside of a fixed bulkhead 68, which forms a part of the housing 62 and is parallel to the floor 66. Both the floor 66 and bulkhead 68 are oriented substantially horizontally. The connection between the output shaft 64 and hub 65 is located in a central opening 69 in the bulkhead 68.

The upper module 48 is enclosed in a housing 70 having a top wall 71 which includes a central opening 72 that receives the output shaft 73 of a hydraulic drive motor 74. Motor 74 is mounted on a bracket 75 which, in turn, is mounted on top wall 71. Output shaft 73 is connected to central hub 76 of upper module 48. The housing 70 includes a mid-level bulkhead 77 which includes a central opening 78 into which are journaled stub shafts 79, 80 of upper and lower modules 48, 50, respectively. Bulkhead 77 also includes an opening 81 which allows material to pass from the upper module 48 to the lower module 50. Consequently, motors 63, 74 can be activated selectively to rotate upper and lower modules 48, 50 in unison or individually about a central axis of the filler 10.

The upper module 48 includes six cylindrical chambers 82, 84, 86, 88, 90, 92, each sized to approximate the volume of a canister 52 of waste. The lower module 50 includes a divider wall 93 forming six spokes 94, 96, 98, 100, 102, 104. Spokes 94-104 form six chambers 106, 108, 110, 112, 114, 116 between them, each sized to receive a canister 52. Upper module 48 is enclosed in a cylindrical side wall 118, which extends between top wall 71 and bulkhead 77. Lower module 50 is partially enclosed in side wall 120, which extends from bulkhead 77 downwardly to bulkhead 68. However, as shown is FIG. 1, lower side wall 120 does not completely enclose lower module 50, but forms inlet and discharge stations 122, 124, respectively, which allows empty canisters 52 to be placed into the lower module, and filled canisters 52' to be discharged from the lower module.

It is to be understood that the operation of the cartridge filler 10 with respect to chambers 82–92 and 106–116 is identical for each chamber as the modules 48,50 are rotated. Therefore, the description of the operation of the cartridge filler 10 will be described only with respect to chambers 82 and 106 of the upper and lower modules 48, 50, respectively. In operation, at the inlet station 122, an empty canister 52, preferably a plastic or fiber drum, enters chamber 116 in the lower module by powered infeed conveyor 126. The motors 63,74 of turret 61 rotate the modules 48,50 counter-clockwise to a second station 128 (see FIG. 3) wherein chamber 82 and chamber 116 including the canister 52 are purged with nitrogen from tank 129.

Once the chambers 82, 116 are purged, the turret 61 rotates to a third station 130 (see FIGS. 1 and 3), wherein chamber 82 is filled by feeding component 20 with a discrete volume of shredded material through hole 56. Once chamber 82 has been filled, the modules 48,50 are rotated to a fourth station 132 wherein the waste material is discharged from chamber 82 downwardly through opening 81 into the canister 52 located in chamber 116. The waste material is urged downwardly into the canister 52 by a double-acting, hydraulic discharge cylinder 134 mounted on the top wall 71 of the upper die module 48. The discharge cylinder 134 includes a piston rod 136 terminating in a disc 138 sized to extend across chamber 82. The modules are then rotated to a fifth station 140 where the air remaining in both the upper and lower chambers 82, 116 is evacuated to a charcoal canister 142 through conduit 144. The modules 48,50 are rotated to the discharge station 124 where the filled canister 52 is sealed and removed from chamber 114 by a discharge conveyor 146. The modules 48,50 are then rotated further counter-clockwise to bring chambers 82, 116 back to position station 122 to receive another empty canister 52. With each rotation of the filler 10 the operations described at each position 122,128,130,140,124 simultaneously occurring.

While the form of apparatus herein described constitutes a preferred embodiment of the invention, it is to be understood that the invention is not so limited to this form of apparatus and that other forms of apparatus may be employed without departing from the scope of the invention. Specifically, the cartridge filler can be used for other waste processing applications, such as non-hazardous waste, where the prevention of leakage of the waste to the ambient is desirable. The cartridge filler can also be attached to other types of waste feed systems such as a skip hoist or conveyors for example.

What is claimed is:

1. A rotary cartridge filler for containerization of processed waste material comprising:

upper means including a cylindrical die module having a plurality of chambers for receiving predetermined volumes of waste, said upper means being sealed from the ambient;

lower means including a cylindrical canister module having a plurality of chambers for receiving empty containers;

means for indexing said upper and lower means through a plurality of stations, said predetermined volume of waste in said upper means being indexed from one of said stations to another; and means mounted above one of said chambers of said upper means for positively displacing said volumes of waste from said upper means to said containers in said lower means, said lower means being sealed from the ambient whereby leakage of said waste material to the ambient is minimized, wherein one of said stations is capable of charging a predetermined volume of waste into a selected one of said chambers of said upper means, and a distinct one of said stations is capable of transferring said predetermined volume of waste from said selected chamber to said lower means by using said positive displacing means.

2. The cartridge filler of claim 1 wherein said upper means and said lower means are aligned on an axis and are separated by a wall.

3. The cartridge filler of claim 2 wherein said wall contains an opening for allowing said volumes of waste to pass from said upper means to said lower means.

4. The cartridge filler of claim 3 further comprising turret means for mounting said upper means and said lower means; and means for rotating said turret about said axis.

5. The cartridge filler of claim 1 wherein said plurality of chambers are spaced around an outer perimeter of said modules, said chambers being vertically aligned.

6. The cartridge filler of claim 5 wherein said modules each contain six chambers.

7. The cartridge filler of claim 5 wherein said canister module includes means for receiving an empty container in a chamber in a first station.

8. The cartridge filler of claim 7 wherein said canister module includes means for purging a chamber with nitrogen in a second station.

9. The cartridge filler of claim 8 wherein said die module includes means for receiving said volume of waste in a third station.

10. The cartridge filler of claim 9 further comprising a fourth station where said waste is discharged through said hole from said die module chamber at said fourth station to said container in one of said canister module chambers at said fourth station.

11. The cartridge filler of claim 10 further comprising means for evacuating air in said canister module chamber after waste has been removed to said canister module chamber at said fourth station and said die module chamber having a container charged with waste from said fourth station.

12. The cartridge filler of claim 11 further comprising means for sealing and removing said filled canister from said canister module at a sixth station.

13. The cartridge filler of claim 1 wherein said means for positively displacing includes a discharge cylinder positioned above said upper means.

14. The cartridge filler of claim 1 wherein said waste includes hazardous waste.

15. The cartridge filler of claim 1 wherein said upper means is sized to receive a volume of waste which is equal to a volume of one of said containers in said lower means.

16. A rotary cartridge filler for containerization of processed waste material comprising:

upper means for receiving predetermined volumes of waste, said upper means being sealed from the ambient;

lower means for receiving empty containers;

means for rotating said upper and lower means;

means for charging said volumes of waste from said upper means to said containers in said lower means, said lower means being sealed from the ambient whereby leakage of said waste material to the ambient is minimized; and means for connecting said filler to an auger/shredder system.

17. A rotary cartridge filler for disposal of waste in containers in a controlled environment comprising:

an upper die module for receiving volumes of waste and having a plurality of sealable cylindrical chambers spaced about an outer periphery of said upper module;

a lower canister module for receiving empty containers and having a plurality of sealable cylindrical chambers spaced about an outer periphery of said lower module and being coaxial with said upper module chambers;

said upper module and said lower module being separated by a wall having an opening for allowing waste to pass from said upper module to said lower module;

a discharge cylinder located above said upper module for positively displacing said waste from said upper module to one of said containers in said lower module; and a turret for rotating said upper and lower modules about said axis, whereby containers in said lower module chambers are filled in a controlled environment so that leakage of said waste to the ambient is minimized.

18. The cartridge filler of claim 17 wherein said canister module includes means for receiving an empty container in a chamber in a first station.

19. The cartridge filler of claim 18 wherein said canister module includes means for purging a chamber with nitrogen in a second station.

20. The cartridge filler of claim 19 wherein said upper module includes means for receiving said volume of waste in a third station.

21. The cartridge filler of claim 20 further comprising a fourth station where said waste is discharged through said hole from said upper module chamber at said fourth station to said container in one of said canister module chambers at said fourth station.

22. The cartridge filler of claim 21 further comprising means for wherein said evacuating air in said canister module chamber after waste has been removed to said canister module chamber at said fourth station and said upper module chamber having a container charged with waste from said fourth station.

23. The cartridge filler of claim 22 further comprising means for sealing and removing said filled canister from said canister module at a sixth station.

24. A method for containerizing hazardous waste for minimizing leakage of waste to the ambient by utilizing a cartridge filler having an upper die module and an axially aligned lower canister module comprising the steps of:

placing an empty container in a first chamber in said lower canister module in a first station;

rotating the filler to a second station;

purging said container and a corresponding die module chamber with nitrogen;

rotating said filler to a third station;

filling said die module chamber with a discrete volume of waste;

rotating said filler to a fourth station;

discharging said waste from said die module chamber to said container;

rotating said filler to a fifth station;

evacuating air from said die module chamber and said canister module chamber;

rotating said filler to a sixth station; and sealing and removing said container from said canister module chamber.

25. The method of claim 24 wherein said upper die module and said lower canister module are rotated independently.

26. The method of claim 24 wherein said upper die module and said lower canister module are rotated simultaneously.

27. A rotary cartridge filler for containerization of processed waste material comprising:

an upper module for receiving predetermined volumes of waste, said upper module being sealable from the ambient;

a lower module for receiving empty containers, said lower module being sealable from the ambient;

means for rotating said upper and lower modules so that predetermined volumes of waste in said upper module can be rotated by said upper module;

means mounted above said upper module for positively displacing said volumes of waste from said upper module to said containers in said lower module; and means for purging said upper and lower modules with a gas prior to displacing said waste, so that said waste is displaced in a reduced oxygen atmosphere.

* * * * *